US012137769B2

(12) United States Patent
Seid

(10) Patent No.: US 12,137,769 B2
(45) Date of Patent: Nov. 12, 2024

(54) SOLE STRUCTURE FOR ARTICLE OF FOOTWEAR

(71) Applicant: NIKE, Inc., Beaverton, OR (US)

(72) Inventor: Aaron K. Seid, Portland, OR (US)

(73) Assignee: NIKE, Inc.

( * ) Notice: Subject to any disclaimer, the term of this patent is extended or adjusted under 35 U.S.C. 154(b) by 21 days.

(21) Appl. No.: 17/331,249

(22) Filed: May 26, 2021

(65) Prior Publication Data

US 2021/0368923 A1 Dec. 2, 2021

Related U.S. Application Data

(60) Provisional application No. 63/032,670, filed on May 31, 2020.

(51) Int. Cl.
*A43B 13/20* (2006.01)
*A43B 13/18* (2006.01)

(52) U.S. Cl.
CPC ..... *A43B 13/20* (2013.01); *A43B 13/186* (2013.01)

(58) Field of Classification Search
CPC ..... A43B 13/20; A43B 13/206; A43B 5/10; A43B 3/0036; A43B 13/12; A43B 13/125; A43B 13/127; A43B 13/145; A43B 13/146; A43B 13/18; A43B 13/181; A43B 13/184; A43B 13/186; A43B 13/187; A43B 13/188; A43B 13/189; A43B 21/28; A43B 21/26; A43B 21/32; A43B 13/203; A43B 13/143
(Continued)

(56) References Cited

U.S. PATENT DOCUMENTS 5,245,766 A * 9/1993 Warren ..... A43B 13/189 36/28
5,713,141 A 2/1998 Mitchell et al.
(Continued)

FOREIGN PATENT DOCUMENTS

KR 20180058226 A 5/2018

OTHER PUBLICATIONS

European Patent Office, PCT International Search Report and Written Opinion dated Sep. 10, 2021 for application No. PCT/US2021/034364.

*Primary Examiner* — Jameson D Collier
*Assistant Examiner* — Matthew R Marchewka
(74) *Attorney, Agent, or Firm* — Honigman LLP; Matthew H. Szalach; Jonathan P. O'Brien

(57) ABSTRACT

A sole structure for an article of footwear includes a bladder having an inner chamber and a peripheral chamber completely surrounding the inner chamber. The inner chamber defines a first interior void having a tensile element received therein and providing the inner chamber with a constant thickness. The inner chamber may be arcuate and curve continuously from a first end of the bladder to a second end of the bladder. The peripheral chamber extends from and completely surrounds the inner chamber, and has a variable thickness that is greater than the constant thickness of the first inner chamber. The inner chamber and the peripheral chamber are in fluid communication with each other, and the peripheral chamber includes a plurality of deformation zones configured to deform to accommodate a pressure increase within the inner chamber.

20 Claims, 8 Drawing Sheets

(58) Field of Classification Search
USPC ..... 36/28, 29, 35 B, 35 R
See application file for complete search history.

(56) References Cited

U.S. PATENT DOCUMENTS

| | | | | |
|---|---|---|---|---|
| 5,952,065 | A | 9/1999 | Mitchell et al. | |
| 5,987,780 | A * | 11/1999 | Lyden | A43B 13/206 36/35 B |
| 6,582,786 | B1 | 6/2003 | Bonk et al. | |
| 8,789,294 | B2 * | 7/2014 | Dojan | B29D 35/122 36/25 R |
| 2001/0042321 | A1 * | 11/2001 | Tawney | A43B 13/20 36/43 |
| 2007/0063368 | A1 * | 3/2007 | Schindler | A43B 13/189 249/134 |
| 2009/0288313 | A1 * | 11/2009 | Rapaport | B29C 66/433 36/29 |
| 2012/0233880 | A1 * | 9/2012 | Chao | B29D 35/142 12/146 B |
| 2012/0260526 | A1 | 10/2012 | Smith et al. | |
| 2018/0064208 | A1 * | 3/2018 | Hurd | A43B 13/186 |
| 2018/0255871 | A1 * | 9/2018 | Conway | A43B 13/20 |
| 2018/0332925 | A1 | 11/2018 | Bailey et al. | |
| 2019/0062614 | A1 * | 2/2019 | Steinbeck | A43B 13/16 |
| 2019/0223551 | A1 * | 7/2019 | Hoffer | A43B 13/189 |
| 2019/0365036 | A1 | 12/2019 | Meeker | |
| 2020/0221821 | A1 * | 7/2020 | Wijesundara | A43B 17/03 |

* cited by examiner

SOLE STRUCTURE FOR ARTICLE OF FOOTWEAR

CROSS REFERENCE TO RELATED APPLICATIONS

This application claims priority under 35 U.S.C. § 119(e) to U.S. Provisional Application 63/032,670, filed on May 31, 2020. The disclosure of this prior application is considered part of the disclosure of this application and is hereby incorporated by reference in its entirety.

FIELD

The present disclosure relates generally to sole structures for articles of footwear, and more particularly, to sole structures incorporating a fluid-filled bladder.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to increase durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing fluid-filled bladders typically include a bladder formed from two barrier layers of polymer material that are sealed or bonded together. The fluid-filled bladders are pressurized with a fluid such as air, and may incorporate tensile members within the bladder to retain the shape of the bladder when compressed resiliently under applied loads, such as during athletic movements. Generally, bladders are designed with an emphasis on balancing support for the foot and cushioning characteristics that relate to responsiveness as the bladder resiliently compresses under an applied load

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
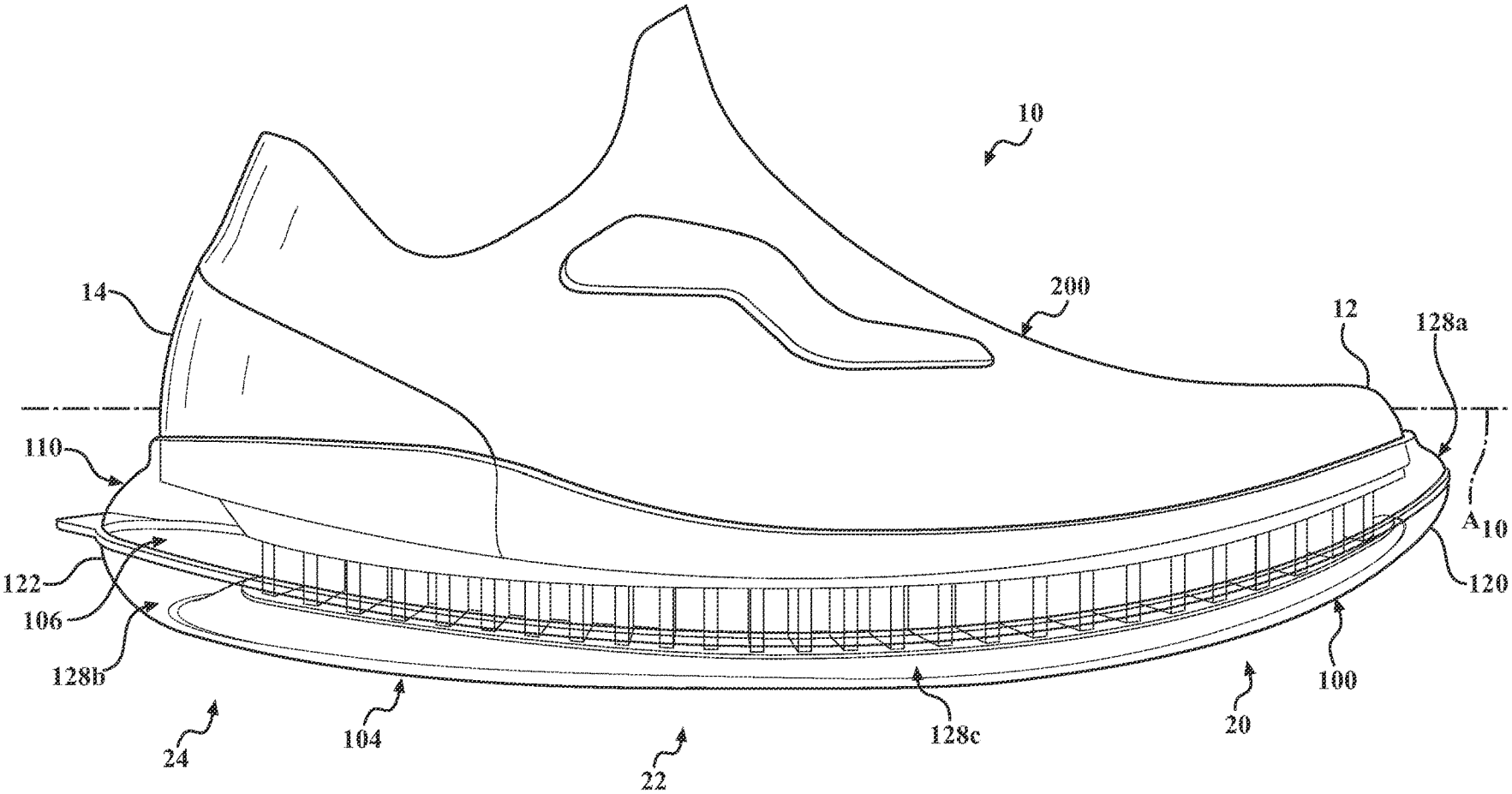
FIG. 1 is a lateral side elevation view of an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, a bladder for an article of footwear is provided and includes an inner chamber having a first interior void and a tensile member disposed within the first interior void, the inner chamber having a constant thickness. The bladder additionally includes a peripheral chamber surrounding the inner chamber and including a second interior void, the peripheral chamber having a variable thickness that is greater than the constant thickness of the inner chamber.

Implementations of the disclosure may include one or more of the following optional features. In some implementations, the peripheral chamber may include one or more deformation zones. The deformation zones may include substantially straight sides of the peripheral chamber. Additionally or alternatively, the deformation zones may be progressively defined along a length of the bladder.

The peripheral chamber may include a posterior segment disposed at a first end of the bladder and an anterior segment disposed at a second end of the bladder, the posterior segment having a greater thickness than the anterior segment. Further, the peripheral chamber may include one or more elongate segments connecting the anterior segment and the posterior segment, the variable thickness of the bladder continuously tapering from the posterior segment to the anterior segment.

A first barrier layer and a second barrier layer may cooperate to define each of the inner chamber and the peripheral chamber. The first barrier layer and the second barrier layer may be attached to the tensile member in the inner chamber.

The inner chamber may be curved along a lengthwise direction of the bladder. Additionally or alternatively, the inner chamber may be straight along a widthwise direction of the bladder.

In another configuration, a bladder for an article of footwear is provided and includes an inner chamber having a constant thickness and a peripheral chamber completely surrounding and in fluid communication with the inner chamber, the peripheral chamber having a greater thickness than the inner chamber and including one or more deformation zones.

Implementations of the disclosure may include one or more of the following optional features. In some implementations, the one or more deformation zones may include a plurality of deformation zones extending along the peripheral chamber. The one or more deformation zones may be defined by substantially straight sides of the peripheral chamber. Additionally or alternatively, the deformation zones may be progressively defined along a length of the bladder.

The peripheral chamber may include a posterior segment disposed at a first end of the bladder and an anterior segment disposed at a second end of the bladder, the posterior segment having a greater thickness than the anterior segment. Additionally or alternatively, the peripheral chamber may include one or more elongate segments connecting the anterior segment and the posterior segment, the thickness of the bladder continuously tapering from the posterior segment to the anterior segment.

A first barrier layer and a second barrier layer may cooperate to define each of the inner chamber and the peripheral chamber. Further, the first barrier layer and the second barrier layer may be attached to a tensile member in the inner chamber.

The inner chamber may be curved along a lengthwise direction of the bladder. Additionally or alternatively, the inner chamber may be straight along a widthwise direction of the bladder.

The details of one or more implementations of the disclosure are set forth in the accompanying drawings and the description below. Other aspects, features, and advantages will be apparent from the description and drawings, and from the claims.

Figure 2:
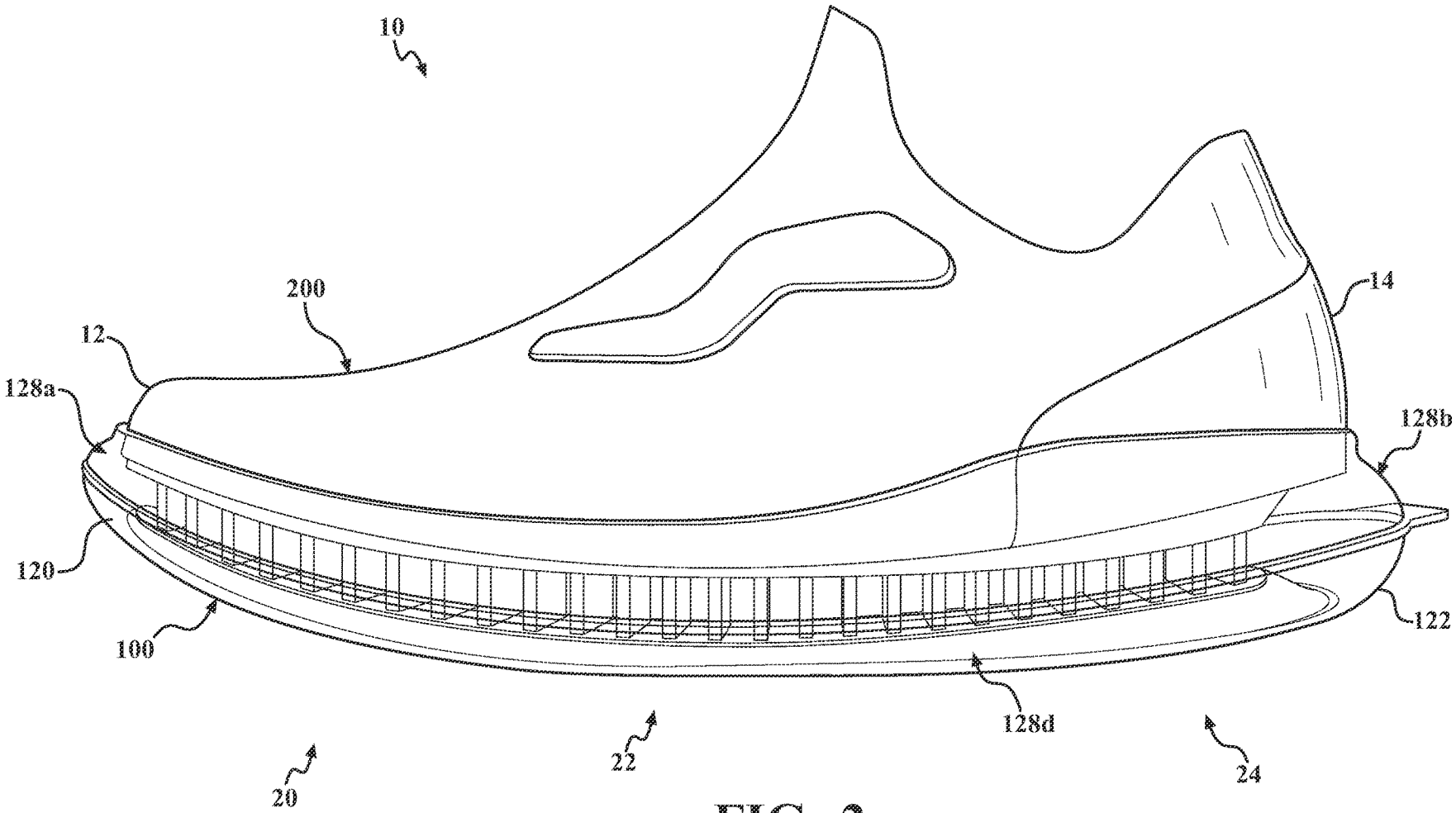
FIG. 2 is a medial side elevation view of the article of footwear of FIG. 1.
Figure 3:
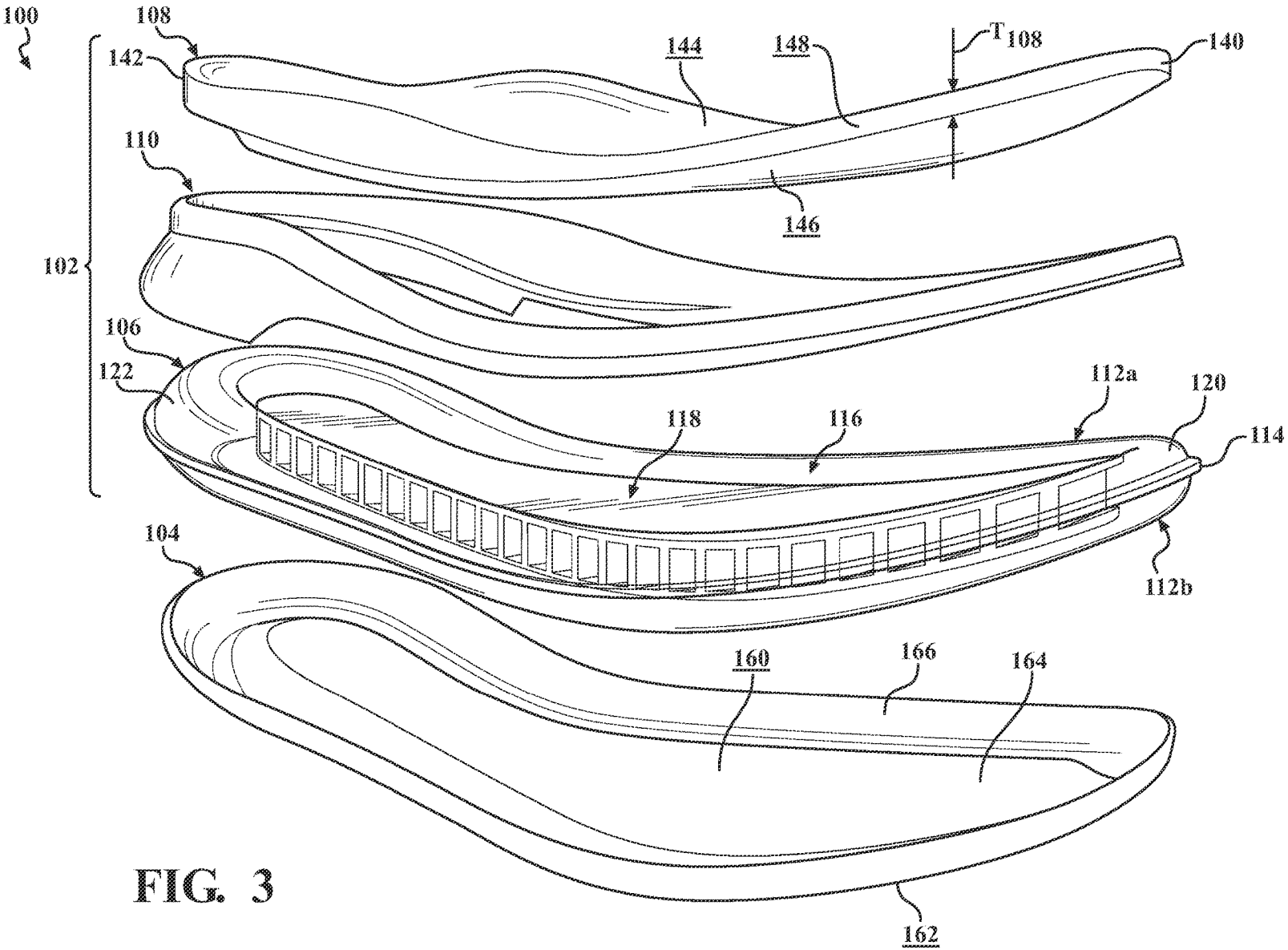
FIG. 3 is an exploded view a sole structure of the article of footwear of FIG. 1.

Referring to FIGS. 1-3, an article of footwear 10 includes a sole structure 100 and an upper 200 attached to the sole structure 100. The article of footwear 10, and components thereof, may be described as including an anterior end 12 associated with a forward-most point of the footwear 10, and a posterior end 14 corresponding to a rearward-most point of the footwear 10. As shown in FIG. 1, a longitudinal axis $A_{10}$ of the footwear 10 extends along a length of the footwear 10 from the anterior end 12 to the posterior end 14. The longitudinal axis $A_{10}$ generally divides the footwear 10 into a lateral side 16 and a medial side 18. Accordingly, the lateral side 16 and the medial side 18 respectively correspond with opposite sides of the footwear 10 and extend from the anterior end 12 to the posterior end 14.

The article of footwear 10 may be divided into one or more regions along the longitudinal axis $A_{10}$. The regions may include a forefoot region 20, a mid-foot region 22, and a heel region 24. The forefoot region 20 may correspond with toes and joints connecting metatarsal bones with phalanx bones of a foot. The mid-foot region 22 may correspond with an arch area of the foot, and the heel region 24 may correspond with rear regions of the foot, including a calcaneus bone.

Figure 4:
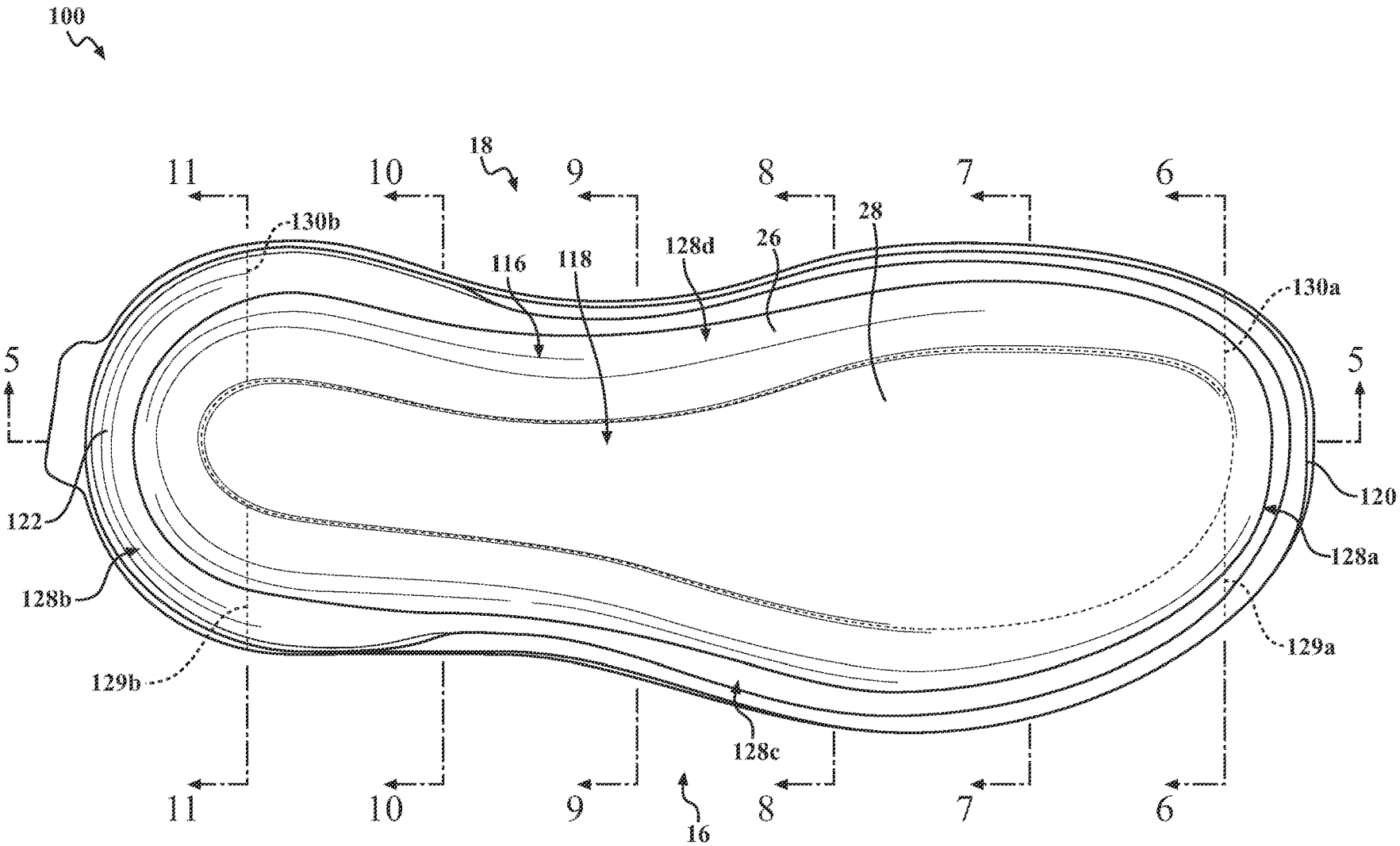
FIG. 4 is top plan view of the article of footwear of FIG. 1.

The article of footwear 10, and more particularly, the sole structure 100, may be further described as including a peripheral region 26 and an interior region 28, as indicated by the dashed line in FIG. 4. The peripheral region 26 is generally described as being a region between the interior region 28 and an outer perimeter of the sole structure 100. Particularly, the peripheral region 26 extends from the forefoot region 20 to the heel region 24 along each of the lateral side 16 and the medial side 18, and wraps around each of the forefoot region 20 and the heel region 24. The interior region 28 is circumscribed by the peripheral region 26, and extends from the forefoot region 20 to the heel region 24 along a central portion of the sole structure 100. Accordingly, each of the forefoot region 20, the mid-foot region 22, and the heel region 24 may be described as including the peripheral region 26 and the interior region 28.

With reference to FIG. 3, the sole structure 100 includes a midsole 102 configured to provide cushioning characteristics to the sole structure 100, and an outsole 104 configured to provide a ground-engaging surface of the article of footwear 10. Unlike conventional sole structures, which include unitary midsoles formed of a single material, the midsole 102 is formed compositely and includes multiple subcomponents. For example, the midsole 102 includes a bladder 106 and an upper cushion 108 stacked upon the bladder 106. Additionally, the midsole 102 may include a peripheral support member 110 surrounding an outer periphery of the bladder 106 and the upper cushion 108. The subcomponents 106, 108, 110 are assembled and secured to each other using various methods of bonding, including adhesively bonding and melding, for example.

With reference to FIGS. 3-11, the bladder 106 of the midsole 102 includes an opposing pair of barrier layers 112*a*, 112*b*, which can be joined to each other along a peripheral seam 114 to form a peripheral chamber 116 and an inner chamber 118. As shown, the barrier layers 112*a*, 112*b* include a first, upper barrier layer 112*a* and a second, lower barrier layer 112*b*.

As used herein, the term "barrier layer" (e.g., barrier layers 112*a*, 112*b*) encompasses both monolayer and multilayer films. In some embodiments, one or both of the barrier layers 112*a*, 112*b* are each produced (e.g., thermoformed or blow molded) from a monolayer film (a single layer). In other embodiments, one or both of the barrier layers 112*a*, 112*b* are each produced (e.g., thermoformed or blow molded) from a multilayer film (multiple sublayers). In either aspect, each layer or sublayer can have a film thickness ranging from about 0.2 micrometers to about be about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier layers 112*a*, 112*b* can independently be transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 112*a*, 112*b* can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4, 4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including hydrogenated MDI (HMDI), TDI, MDI, hydrogenated (H12) aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier layers 112*a*, 112*b* may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier layers 112*a*, 112*b* include two or more sublayers, examples of suitable multilayer films include microlayer films, such as those disclosed in Bonk et al., U.S. Pat. No. 6,582,786, which is incorporated by reference in its entirety. In further embodiments, barrier layers 112*a*, 112*b* may each independently include alternating sublayers of one or more TPU copolymer materials and one or more EVOH copolymer materials, where the total number of sublayers in each of barrier layers 112*a*, 112*b* includes at least four (4) sublayers, at least ten (10) sublayers, at least twenty (20) sublayers, at least forty (40) sublayers, and/or at least sixty (60) sublayers.

The bladder 106 can be produced from barrier layers 112*a*, 112*b* using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, barrier layers 112*a*, 112*b* can be produced by co-extrusion followed by vacuum thermoforming to produce an inflatable bladder 106, which can optionally include one or more valves (e.g., one way valves) that allows bladder 106 to be filled with the fluid (e.g., gas).

The chambers 116, 118 of the bladder 106 can be provided in a fluid-filled (e.g., as provided in footwear 10) or in an unfilled state. The chambers 116, 118 can be filled to include any suitable fluid, such as a gas or liquid. In an aspect, the gas can include air, nitrogen ($N_2$), or any other suitable gas. The fluid provided to the chambers 116, 118 can result in the bladder 106 being pressurized. Alternatively, the fluid provided to the chambers 116, 118 can be at atmospheric pressure such that the bladder 106 is not pressurized but, rather, simply contains a volume of fluid at atmospheric pressure. In other aspects, the chambers 116, 118 can alternatively include other media, such as pellets, beads, ground recycled material, and the like (e.g., foamed beads and/or rubber beads).

The barrier layers 112*a*, 112*b* desirably have a low gas transmission rate to preserve its retained gas pressure. In some embodiments, the barrier layers 112*a*, 112*b* have a gas transmission rate for nitrogen gas that is at least about ten (10) times lower than a nitrogen gas transmission rate for a butyl rubber layer of substantially the same dimensions. In an aspect, the barrier layers 112*a*, 112*b* have a nitrogen gas transmission rate of 15 cubic-centimeter/square-meter/atmosphere/day ($cm^3/m^2 \cdot atm \cdot day$) or less for an average film thickness of 500 micrometers (based on thicknesses of barrier layers 112*a*, 112*b*). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

Figure 5:
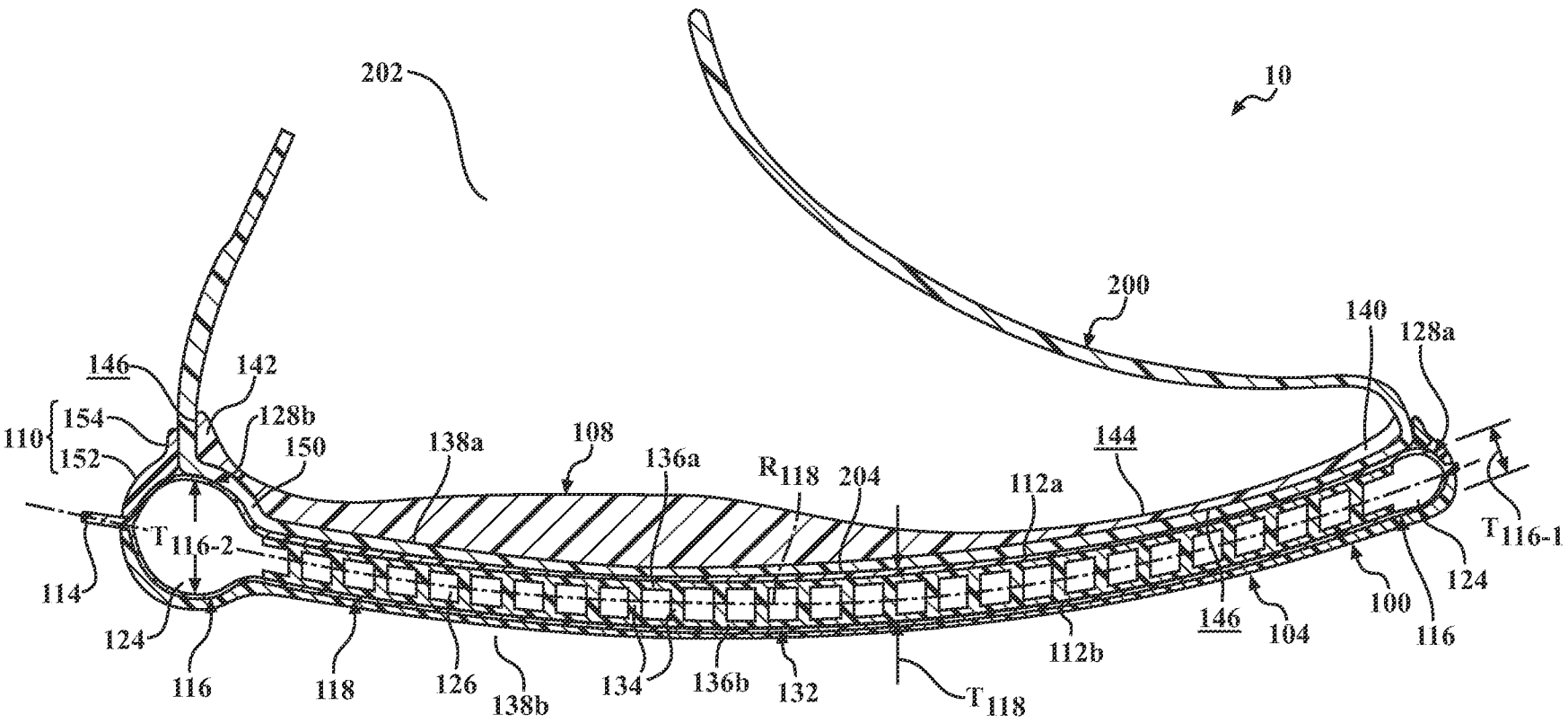
FIG. 5 is a cross-sectional view of the article of footwear of FIG. 1, taken along Line 5-5 of FIG. 4 and corresponding to a longitudinal axis of the article of footwear.

In some implementations, the upper barrier layer 112*a* and the lower barrier layer 112*b* cooperate to define a geometry (e.g., shape, thicknesses, width, and lengths) of the bladder 106. For example, the barrier layers 112*a*, 112*b* may be joined together along the peripheral seam 114 to define an outer periphery of the bladder 106 and to seal the fluid (e.g., air) within the peripheral chamber 116 and the inner chamber 118. As shown in FIGS. 3-5, a length of the bladder 106 extends continuously from a first end 120 disposed at the anterior end 12 of the footwear 10 to a second end 122 disposed at the posterior end 14 of the footwear 10.

The peripheral chamber 116 is formed in the peripheral region 26 of the bladder 106 and extends continuously and uninterrupted along the outer periphery of the bladder 106. As shown in FIGS. 5-11, the barrier layers 112*a*, 112*b* are spaced apart from each other in the peripheral region 26 to define the peripheral chamber 116. Particularly, the interior surfaces of the barrier layers 112*a*, 112*b* are separated from each other such that the space between the barrier layers 112*a* defines an interior void 124 of the peripheral chamber 116, while a distance across exterior surfaces of the barrier layers 112*a*, 112*b* defines thicknesses $T_{116}$ of the peripheral chamber 116. As shown, the upper and lower barrier layers 112*a* cooperate to provide the peripheral chamber 116 with a tubular shape having a greater thickness $T_{116}$ than the inner chamber 118. In other words, the peripheral chamber 116 forms a bulbous or distended portion of the bladder 106 extending continuously and uninterrupted around the entire perimeter of the bladder 106.

Although the peripheral chamber 116 is continuously formed around the perimeter of the bladder 106, the peripheral chamber 116 may be described as including a plurality of segments 128*a*-128*d* each corresponding with an end 120, 122 or side 16, 18 of the bladder 106. For example, FIG. 4 shows that the peripheral chamber 116 includes an anterior segment 128*a* disposed at the first end 120 of the bladder 106, a posterior segment 128*b* disposed at the second end 122 of the bladder 106, a lateral side segment 128*c* extending continuously along the lateral side 16 of the bladder 106, and a medial side segment 128*d* extending continuously along the medial side 18 of the bladder 106.

With reference to FIGS. 4 and 5, the anterior segment 128*a* extends along an arcuate path around the first end 120 of the bladder 106 from a first end 129*a* on the lateral side 16 of the bladder 106 to a second end 130*a* on the medial side 18 of the bladder 106. The anterior segment 128*a* defines a first thickness $T_{116\text{-}1}$ of the peripheral chamber 116 at the first end 120. The posterior segment 128*b* extends along an arcuate path around the second end 122 of the bladder 106 from a first end 129*b* disposed on the lateral side 16 to a second end 130*b* disposed on the medial side 18. The posterior segment 128*b* defines a second thickness $T_{116\text{-}2}$ of the peripheral chamber 116. The second thickness $T_{116\text{-}2}$ is greater than the first thickness $T_{116\text{-}1}$ such that the peripheral chamber 116 is thicker at the second end 122 than at the first end 120.

The anterior segment 128*a* and the posterior segment 128*b* of the peripheral chamber 116 are connected by a pair of elongate side segments 128*c*, 128*d* that each extend along the length of the bladder from the first end 120 to the second end 122. With reference to FIGS. 1, 4 and 6-11, a first one of the side segments 128*c* includes a lateral side segment 128*c* extending continuously along the lateral side from the first end 129*a* of the anterior segment 128*a* to the first end 129*b* of the posterior segment 128*b*. Generally, the thickness of the peripheral chamber 116 tapers continuously along each of the side segments 128*c*, 128*d* from the second thickness $T_{116\text{-}2}$ at the second end 122 to the first thickness $T_{116\text{-}1}$ at the first end 120.

Figure 6:
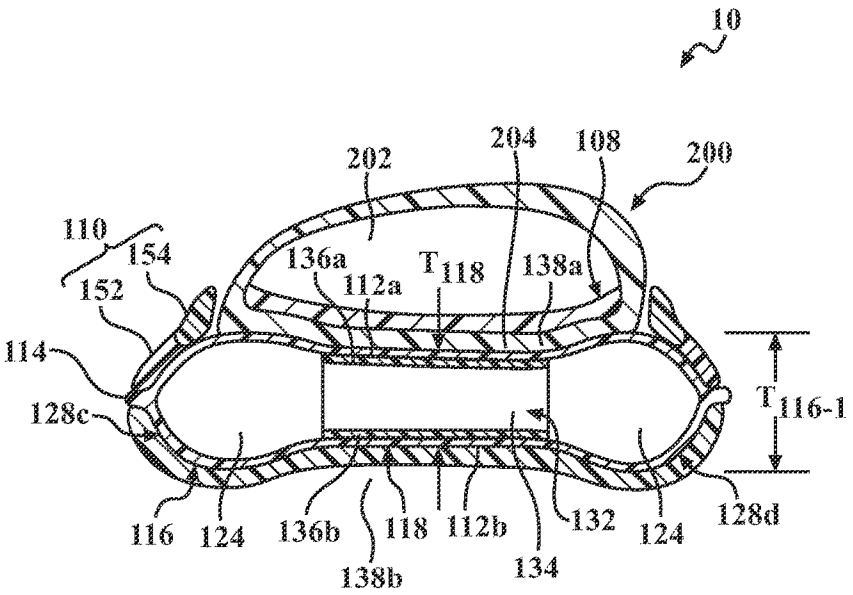
FIG. 6 is a cross-sectional view of the article of footwear of FIG. 1, taken along Line 6-6 of FIG. 4.
Figures 10, 11:
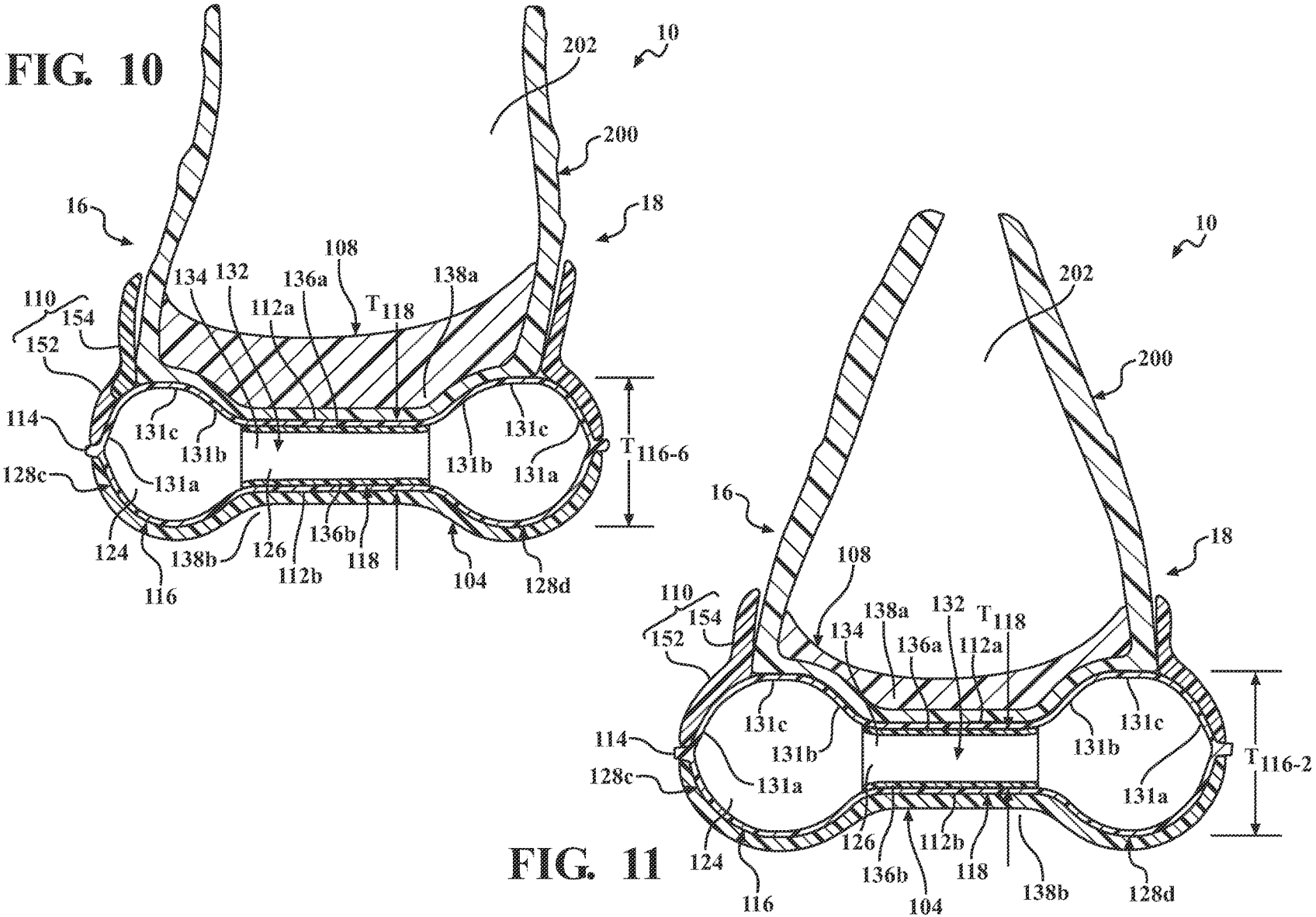
FIG. 10 is a cross-sectional view of the article of footwear of FIG. 1, taken along Line 10-10 of FIG. 4.
FIG. 11 is a cross-sectional view of the article of footwear of FIG. 1, taken along Line 11-11 of FIG. 4.

As indicated in FIG. 4, the cross-sectional views of FIGS. 6-11 are taken in series along the length of the bladder 106 and illustrate the progressive increase in the thickness $T_{116}$ of the peripheral chamber 116 from the anterior segment 128*a* to the posterior segment 128*b*. For example, FIG. 6 is a cross-sectional view taken across the bladder 106 where the side segments 128*c*, 128*d* connect to the ends 129*a*, 130*a* of the anterior segment 128*a*. Here, each of the side segments 128*c*, 128*d* has the same thickness $T_{116\text{-}1}$ as the anterior segment 128*a*. FIGS. 7-10 are cross-sectional views taken along intermediate portions (i.e., between the anterior segment 128*a* and posterior segment 128*b*) of the bladder 106, as indicated in FIG. 4. As shown, the intermediate portions of the side segments 128*c*, 128*d* include thicknesses $T_{116\text{-}3}$ (FIG. 7), $T_{116\text{-}4}$ (FIG. 8), $T_{116\text{-}5}$ (FIG. 9), $T_{116\text{-}6}$ (FIG. 10) that progressively and continuously increase along the length of the bladder 106 in a direction toward the heel region 24. FIG. 11 shows a cross-sectional view of the bladder 106 taken where the side segments 128*c*, 128*d* connect to the ends 129*b*, 130*b* of the posterior segment 128*b*. Accordingly, the side segments 128*c*, 128*d* have the same thickness $T_{116\text{-}2}$ as the posterior segment 128*b*.

As set forth above, the barrier layers 112*a*, 112*b* cooperate to provide the peripheral chamber 116 with a tubular shape enclosing a fluid-filled interior void 124. As shown in FIGS. 6-11, at least one of the upper barrier layer 112*a* and the lower barrier layer 112*b* may define one or more deformation zones 131*a*-131*c* along the peripheral chamber 116. In the illustrated example, the peripheral chamber 116 includes a first deformation zone 131*a* extending along an outer portion of the peripheral chamber 116 adjacent to the peripheral seam 114, a second deformation zone 131*b* extending along an inner portion of the peripheral chamber 116 adjacent to the inner chamber 118, and a third deformation zone 131*c* extending along an upper portion of the peripheral chamber 116 and connecting the first deformation zone 131*a* and the second deformation zone 131*b*.

Figure 7:
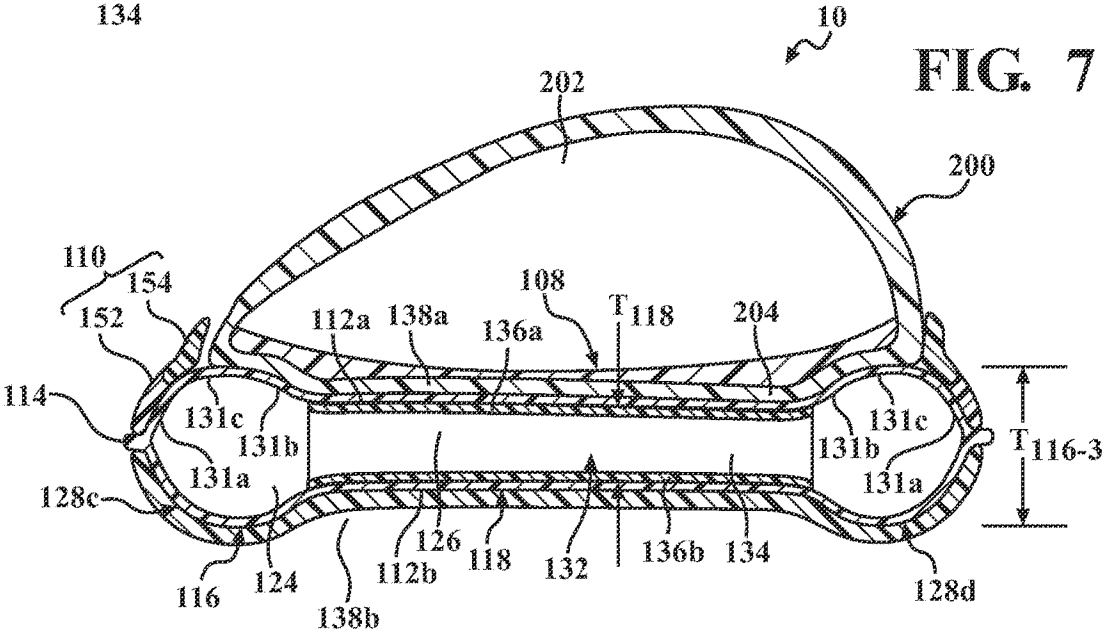
FIG. 7 is a cross-sectional view of the article of footwear of FIG. 1, taken along Line 7-7 of FIG. 4.
Figure 9:
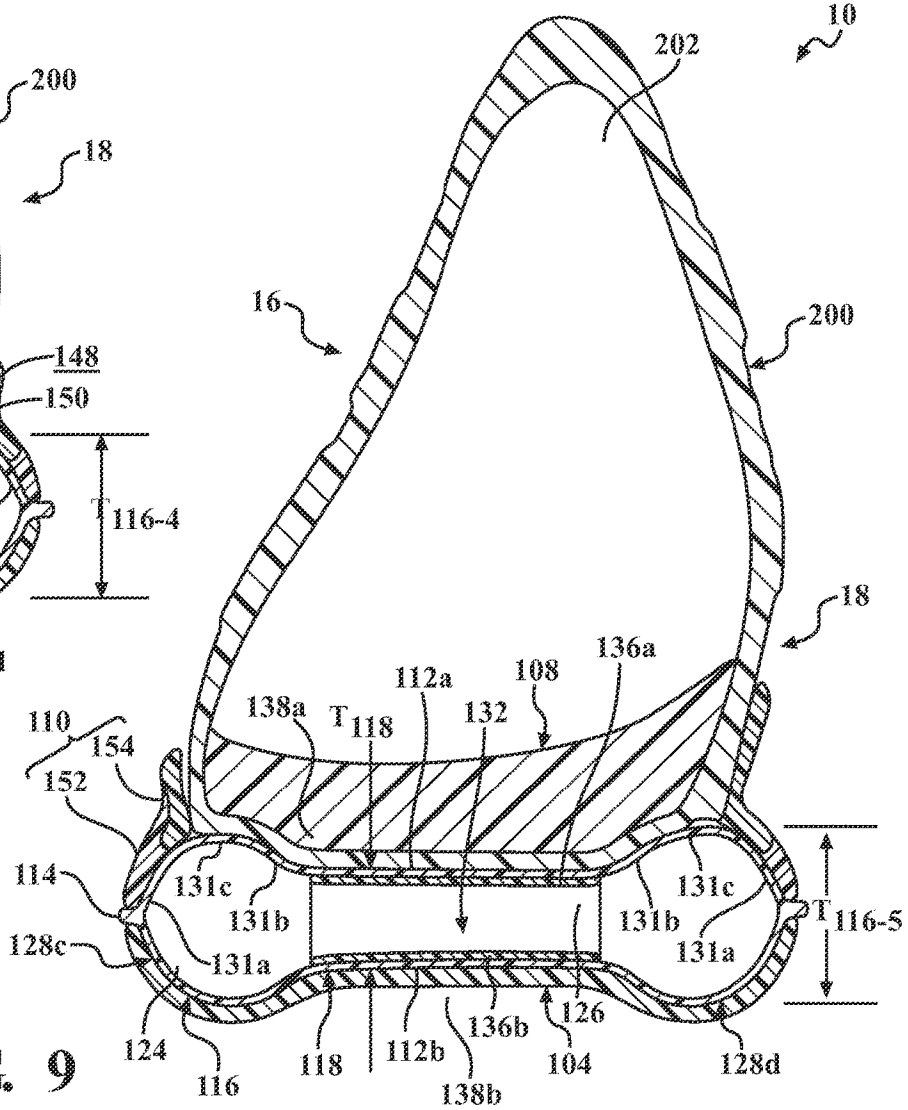
FIG. 9 is a cross-sectional view of the article of footwear of FIG. 1, taken along Line 9-9 of FIG. 4.
Figure 8:
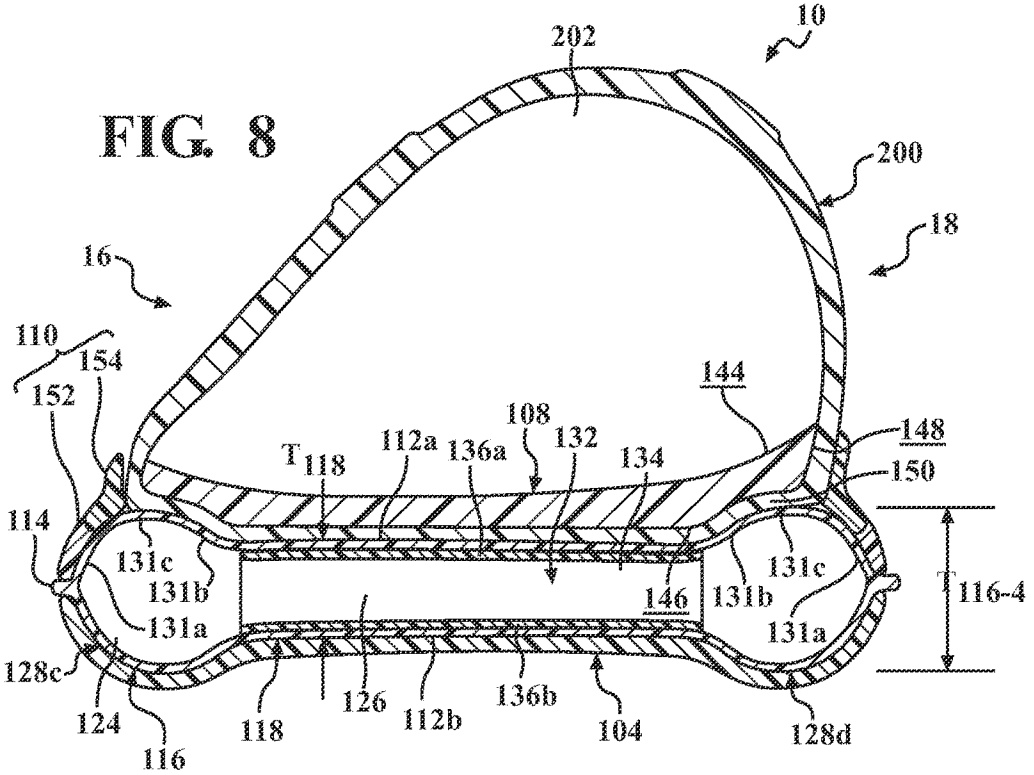
FIG. 8 is a cross-sectional view of the article of footwear of FIG. 1, taken along Line 8-8 of FIG. 4.

In the illustrated example, the portion of the upper barrier layer 112*a* forming the upper portion of the peripheral chamber 116 includes deformation zones 131*a*-131*c* formed as a plurality of connected sides of the peripheral chamber 116. In other words, at least a portion of the peripheral chamber 116 may have a polygonal shape defined by the deformation zones 131*a*-131*c*. As shown in the figures, the deformation zones 131*a*-131*c* may be progressively formed along a direction from the first end 120 of the bladder 106 to the second end 122 of the bladder 106. For instance, the deformation zones 131*a*-131*c* may have slight curvature and be substantially continuous in portions of the peripheral chamber 116 in the forefoot region (FIGS. 6 and 7). Conversely, the deformation zones 131*a*-131*c* may be substantially flat with clearly defined transitions in the portions of the peripheral chamber 116 in the heel region (FIGS. 10 and 11).

In use, the deformation zones 131*a*-131*c* provide expansion regions along the peripheral chamber 116, such that when the bladder 106 is compressed and the pressure within the interior void 124 of the peripheral chamber 116 increases, the upper barrier layer 112*a* can progressively deform to accommodate or absorb the pressure increase. The progressive definition of the deformation zones 131*a*-131*c* along the lengths of the side segments 128*c*, 128*d* provides the heel region 24 with a greater degree of pressure compensation than the forefoot region 20 and mid-foot region 22 to accommodate forces associated with a heel strike.

Referring now to FIGS. 3-11, the inner chamber 118 of the bladder 106 is formed within the interior region 28 of the bladder 106, is continuously and completely surrounded by the peripheral chamber 116, and is in fluid communication with the peripheral chamber 116. Here, the inner chamber 118 extends continuously along a length of the bladder 106 from the anterior segment 128*a* of the peripheral chamber 116 disposed at the first end 120 to the posterior segment 128*b* of the peripheral chamber disposed at the second end 122 of the bladder 106. As shown in FIGS. 6-11, the inner chamber 118 also extends continuously and uninterrupted between the lateral side segment 128*c* and the medial side segment 128*d* along the entire length of the inner chamber 118. Accordingly, the inner chamber 118 may be described as filling the entire space (i.e., the interior region 28) surrounded by the peripheral chamber 116.

As shown in FIGS. 5-11, the inner chamber 118 is formed by portions of the barrier layers 112*a*, 112*b* that are spaced apart from each other in the interior region 28. The space between the barrier layers 112*a*, 112*b*, forms an interior void 126 of the inner chamber 118. The interior void 126 of the inner chamber 118 receives a tensile element 132 therein. The tensile element 132 may include a series of tensile strands or elements 134 extending between an upper tensile sheet 136*a* and a lower tensile sheet 136*b*. The upper tensile sheet 136*a* may be attached to the interior surface of the upper barrier layer 112*a* while the lower tensile sheet 136*b* may be attached to the interior surface of the lower barrier layer 112*b*. In this manner, when the inner chamber 118 receives a pressurized fluid, the tensile strands 134 of the tensile element 132 are placed in tension. Because the upper tensile sheet 136*a* is attached to the upper barrier layer 112*a* and the lower tensile sheet 136*b* is attached to the lower barrier layer 112*b*, the tensile strands 134 retain a desired shape of the inner chamber 118 when the pressurized fluid is injected into the interior void 126.

With continued reference to FIGS. 5-11, when the bladder 106 is inflated, the tensile element 132 provides the inner chamber 118 with a constant thickness $T_{118}$ extending along the length and width of the inner chamber 118. The thickness $T_{118}$ of the inner chamber 118 is less than the thicknesses $T_{116\text{-}1}$-$T_{116\text{-}6}$ of the peripheral chamber 116. As shown, the portions of the upper and lower barrier layers 112*a*, 112*b* forming the inner chamber 118 are inwardly offset from portions the barrier layers 112*a*, 112 forming the peripheral chamber 116. In other words, the portions of the upper and lower barrier layers 112*a*, 112*b* forming the peripheral chamber 116 protrude from the portions of the upper and lower barrier layers 112*a*, 112*b* forming the inner chamber 118.

The inner chamber 118 and the peripheral chamber 116 cooperate to define a pair of pockets or cavities 138*a*, 138*b* on opposite sides of the bladder 106. Particularly, the bladder 106 includes an upper pocket 138*a* defined by the upper barrier layer 112*a* on a top side of the bladder 106 and a lower pocket 138*b* defined by the lower barrier layer 112*b*. A bottom surface of the upper pocket 138*a* is defined by the portion of the upper barrier layer 112*a* extending along the inner chamber 118 and an outer periphery of the upper pocket 138*a* is defined by the portion of the upper barrier layer 112*a* forming an inner portion (i.e., facing the interior region 28) of the peripheral chamber 116. Conversely, a top surface of the lower pocket 138*b* is defined by the portion of the lower barrier layer 112*b* extending along the inner chamber 118 and an outer periphery of the lower pocket 138*b* is defined by the portion of the lower barrier layer 112*b* forming an inner portion (i.e., facing the interior region 28) of the peripheral chamber 116.

In addition to retaining the barrier layer 112*a*, 112*b* to define the thickness $T_{118}$ of the inner chamber 118, the tensile element 132 may be configured to impart an overall shape or contour to the inner chamber 118. As shown in FIGS. 6-11, the inner chamber 118 is substantially straight along the lateral direction from the lateral side 16 to the medial side 18. However, as shown in FIG. 5, the inner chamber 118 may have an arcuate shape extending along the length of the bladder 106. Thus, although the thickness $T_{118}$ of the inner chamber 118 is substantially constant, the shape of the inner chamber 118 may curve from the first end 120 to the second end 122. In the illustrated example, the inner chamber 118 has an "upward" curvature along the longitudinal direction, such that the upper barrier layer 112*a* is concave and the lower barrier layer 112*b* is convex. In some examples, a radius $R_{118}$ of curvature of the inner chamber 118 is substantially constant along the entire length of the inner chamber 118.

In the illustrated example of the bladder 106, the peripheral chamber 116 and the inner chamber 118 are integrally formed by the barrier layers 112*a*, 112*b*. Accordingly, the interior void 124 of the peripheral chamber 116 is in fluid communication with the interior void 126 of the inner chamber 118, such that the entire bladder 106 has a uniform pressure. In use, the inner chamber 118 may be compressed between the ground surface and a plantar surface of the foot during an impact with the ground surface. When compressed, the pressure of the fluid within the bladder 106 increases and the fluid within the inner chamber 118 is displaced from the interior void 126 of the inner chamber 118 to the interior void 124 of the peripheral chamber 116. As set forth above, the portions of the barrier layers 112*a*, 112*b* forming the peripheral chamber 116 may include one or more deformation zones 131*a*-131*c*. When the fluid pressure within the interior void 124 of the peripheral chamber increases and the fluid of the bladder 106 moves into the interior void 124, the deformation zones 131*a*-131*c* of the peripheral chamber 116 are biased outwardly to accommodate the pressure change, thereby providing a damping effect along the peripheral region of the sole structure 100.

With continued reference to FIGS. 3-11, the upper cushion 108 of the midsole is formed of a resilient polymeric material and is configured to be received within the upper pocket 138*a* of the bladder 106. As shown in FIGS. 3 and 5, the upper cushion 108 extends continuously from a first end 140 disposed at the first end 120 of the bladder 106 to a second end 142 disposed at the second end 122 of the bladder 106. The upper cushion 108 further includes a top surface 144 defining a footbed of the sole structure 100 and a bottom surface 146 formed on an opposite side of the upper cushion 108 from the top surface 144. A distance between the top surface 144 and the bottom surface defines a thickness Los of the upper cushion 108. The upper cushion 108 further includes a peripheral side surface 148 extending from the top surface 144 to the bottom surface 146, which defines an outer peripheral profile of the upper cushion 108.

When the sole structure 100 is assembled, the upper cushion 108 is received within the upper pocket 138*a* such that the bottom surface 146 faces the inner chamber 118 and the peripheral side surface 148 mates with the peripheral chamber 116. As shown in FIGS. 5-11, the peripheral side surface 148 may include a concave channel 150 configured to mate with the inner portion of the peripheral chamber 116. In some examples, the upper cushion 108 may be directly disposed within the upper pocket 138*a*, whereby the upper cushion 108 is attached directly to the inner chamber 118 and the peripheral chamber 116. However, in the illustrated example, the upper cushion 108 is configured as a sockliner or insole, and is disposed within an interior void 202 of the upper 200, such that a strobel 204 of the upper 200 is disposed between the bladder 106 and the upper cushion 108.

As described above, the upper cushion 108 is formed of a resilient polymeric material, such as foam or rubber, to impart properties of cushioning, responsiveness, and energy distribution to the foot of the wearer. Example resilient polymeric materials may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Examples of suitable polyurethanes include those discussed above for barrier layers 112*a*, 112*b*. Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as azodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a cross-linking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

The midsole 102 further includes the peripheral support member 110 connecting the peripheral chamber 116 to the upper 200 along the entire periphery of the footwear 10. The peripheral support member 110 includes one or more of the elastomeric materials discussed above with respect to the barrier layers 112*a*, 112*b*. As shown in FIGS. 5-11, the peripheral support member 110 includes a lower portion 152 attached to the outer portion (i.e., facing away from the interior region 28) of the peripheral chamber 116. The peripheral support member 110 also includes an upper portion 154 attached to the exterior of the upper 200. Thus, the peripheral support member 110 is configured to provide lateral stability between the upper 200 and the bladder 106 along the outer periphery of the footwear 10.

The outsole 104 of the sole structure 100 may be formed as an over-molded component covering the entire lower barrier layer 112*b* of the bladder 106, thereby providing the sole structure 100 with an extra layer along the ground surface. As shown in FIG. 3, the outsole 104 includes an inner surface 160 configured to attach to the lower barrier layer 112*b* of the bladder 106, and an outer surface 162 formed on an opposite side of the outsole 104 and configured to provide a ground-contacting surface of the sole structure 100. The outsole 104 also includes an interior portion 164 configured to mate with the lower pocket 138*b* of the bladder 106, and a peripheral channel 166 configured to receive the lower portion of the peripheral chamber 116.

The upper 200 includes interior surfaces that define an interior void 202 configured to receive and secure a foot for support on the sole structure 100. The upper 200 may be formed from one or more materials that are stitched or adhesively bonded together to form the interior void 202. Suitable materials of the upper may include, but are not limited to, mesh, textiles, foam, leather, and synthetic leather. The materials may be selected and located to impart properties of durability, air-permeability, wear-resistance, flexibility, and comfort.

With reference to FIGS. 5-11, in some examples the upper 200 includes the strobel 204 enclosing a bottom portion of the interior void 202. Stitching or adhesives may secure the strobel to the upper 200. As set forth above, the strobel 204 of the upper 200 may be disposed between the bladder 106 and the upper cushion 108 when the article of footwear 10 is assembled.

The following Clauses provide exemplary configurations for a bladder for an article of footwear described above.

Clause 1. A bladder for an article of footwear, the bladder comprising an inner chamber including a first interior void and a tensile member disposed within the first interior void, the inner chamber having a constant thickness. A peripheral chamber surrounds the inner chamber and includes a second interior void, the peripheral chamber having a variable thickness that is greater than the constant thickness of the inner chamber.

Clause 2. The bladder of Clause 1, wherein the peripheral chamber includes one or more deformation zones.

Clause 3. The bladder of Clause 2, wherein the deformation zones include substantially straight sides of the peripheral chamber.

Clause 4. The bladder of Clause 2, wherein the deformation zones are progressively defined along a length of the bladder.

Clause 5. The bladder of any of the preceding Clauses, wherein the peripheral chamber includes a posterior segment disposed at a first end of the bladder and an anterior segment disposed at a second end of the bladder, the posterior segment having a greater thickness than the anterior segment.

Clause 6. The bladder of Clause 5, wherein the peripheral chamber includes one or more elongate segments connecting the anterior segment and the posterior segment, the variable thickness of the bladder continuously tapering from the posterior segment to the anterior segment.

Clause 7. The bladder of any of the preceding Clauses, further comprising a first barrier layer and a second barrier layer cooperating to define each of the inner chamber and the peripheral chamber.

Clause 8. The bladder of Clause 7, wherein the first barrier layer and the second barrier layer are attached to the tensile member in the inner chamber.

Clause 9. The bladder of any of the preceding Clauses, wherein the inner chamber is curved along a lengthwise direction of the bladder.

Clause 10. The bladder of Clause 9, wherein the inner chamber is straight along a widthwise direction of the bladder.

Clause 11. A bladder for an article of footwear, the bladder comprising an inner chamber having a constant thickness and a peripheral chamber completely surrounding and in fluid communication with the inner chamber, the peripheral chamber having a greater thickness than the inner chamber and including one or more deformation zones.

Clause 12. The bladder of Clause 11, wherein the one or more deformation zones includes a plurality of deformation zones extending along the peripheral chamber.

Clause 13. The bladder of any of the preceding Clauses, wherein the one or more deformation zones are defined by substantially straight sides of the peripheral chamber.

Clause 14. The bladder of any of the preceding Clauses, wherein the deformation zones are progressively defined along a length of the bladder.

Clause 15. The bladder of any of the preceding Clauses, wherein the peripheral chamber includes a posterior segment disposed at a first end of the bladder and an anterior segment disposed at a second end of the bladder, the posterior segment having a greater thickness than the anterior segment.

Clause 16. The bladder of Clause 15, wherein the peripheral chamber includes one or more elongate segments connecting the anterior segment and the posterior segment, the thickness of the bladder continuously tapering from the posterior segment to the anterior segment.

Clause 17. The bladder of any of the preceding Clauses, further comprising a first barrier layer and a second barrier layer cooperating to define each of the inner chamber and the peripheral chamber.

Clause 18. The bladder of Clause 17, wherein the first barrier layer and the second barrier layer are attached to a tensile member in the inner chamber.

Clause 19. The bladder of any of the preceding Clauses, wherein the inner chamber is curved along a lengthwise direction of the bladder.

Clause 20. The bladder of Clause 19, wherein the inner chamber is straight along a widthwise direction of the bladder.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A bladder for an article of footwear, the bladder comprising;

an inner chamber including a first interior void and a tensile member disposed within the first interior void, the inner chamber having a constant thickness and extending along a majority of a length of the bladder, the inner chamber having a frontmost end and a rearmost end and having an upwardly concave curvature from the frontmost end to the rearmost end; and a peripheral chamber surrounding and in fluid communication with the inner chamber and including a second interior void, the peripheral chamber having a variable thickness that is greater than the constant thickness of the inner chamber and cooperating with the inner chamber to define a first pocket and a second pocket bounded by the peripheral chamber and extending along the length of the bladder, the first pocket having a bottom surface defined by a portion of a first barrier layer extending along the inner chamber and the second pocket having a top surface defined by a portion of a second barrier layer extending along the inner chamber, the bottom surface being recessed from an apex of each of medial and lateral portions of the peripheral chamber on a first side of the bladder and the top surface being recessed from lowermost surfaces of each of the medial and lateral portions of the peripheral chamber on a second side of the bladder formed on an opposite side of the bladder than the first side.

2. The bladder of claim 1, wherein the peripheral chamber includes one or more deformation zones.

3. The bladder of claim 2, wherein the deformation zones include substantially straight sides of the peripheral chamber.

4. The bladder of claim 2, wherein the deformation zones are positioned along the length of the bladder and are configured to progressively deform along the length of the bladder.

5. The bladder of claim 1, wherein the peripheral chamber includes a posterior segment disposed at a first end of the bladder and an anterior segment disposed at a second end of the bladder, the posterior segment having a greater thickness than the anterior segment.

6. The bladder of claim 5, wherein the peripheral chamber includes one or more elongate segments connecting the anterior segment and the posterior segment, the variable thickness of the peripheral chamber continuously tapering from the posterior segment to the anterior segment.

7. The bladder of claim 1, wherein the first barrier layer and the second barrier layer cooperate to define each of the inner chamber and the peripheral chamber.

8. The bladder of claim 7, wherein the first barrier layer and the second barrier layer are attached to the tensile member in the inner chamber.

9. The bladder of claim 1, wherein the inner chamber is straight along a widthwise direction of the bladder.

10. An article of footwear incorporating the bladder of claim 1.

11. A bladder for an article of footwear, the bladder comprising;

an inner chamber having a constant thickness and extending along a majority of a length of the bladder, the inner chamber having a frontmost end and a rearmost end and having an upwardly concave curvature from the frontmost end to the rearmost end; and a peripheral chamber completely surrounding the inner chamber and including a first end and a second end each in fluid communication with the inner chamber, the peripheral chamber having a greater thickness than the inner chamber and including one or more deformation zones, the peripheral chamber cooperating with the inner chamber to define a first pocket and a second pocket each bounded by the peripheral chamber and extending along the length of the bladder, the first pocket having a bottom surface defined by a portion of a first barrier layer extending along the inner chamber and the second pocket having a top surface defined by a portion of a second barrier layer extending along the inner chamber, the bottom surface being recessed from an apex of each of medial and lateral portions of the peripheral chamber on a first side of the bladder and the top surface being recessed from lowermost surfaces of each of the medial and lateral portions of the peripheral chamber on a second side of the bladder formed on an opposite side of the bladder than the first side.

12. The bladder of claim 11, wherein the one or more deformation zones includes a plurality of deformation zones extending along the peripheral chamber.

13. The bladder of claim 11, wherein the one or more deformation zones are defined by substantially straight sides of the peripheral chamber.

14. The bladder of claim 11, wherein the deformation zones are positioned along the length of the bladder and are configured to progressively deform along the length of the bladder.

15. The bladder of claim 11, wherein the peripheral chamber includes a posterior segment disposed at the first end of the bladder and an anterior segment disposed at the second end of the bladder, the posterior segment having a greater thickness than the anterior segment.

16. The bladder of claim 15, wherein the peripheral chamber includes one or more elongate segments connecting the anterior segment and the posterior segment, the thickness of the peripheral chamber continuously tapering from the posterior segment to the anterior segment.

17. The bladder of claim 11, wherein the first barrier layer and the second barrier layer cooperate to define each of the inner chamber and the peripheral chamber.

18. The bladder of claim 17, wherein the first barrier layer and the second barrier layer are attached to a tensile member in the inner chamber.

19. The bladder of claim 11, wherein the inner chamber is straight along a widthwise direction of the bladder.

20. An article of footwear incorporating the bladder of claim 11.

* * * * *